US006364628B1

(12) United States Patent
Potts et al.

(10) Patent No.: US 6,364,628 B1
(45) Date of Patent: Apr. 2, 2002

(54) VERTICAL SHAFT BLOWER ON TRAILER

(76) Inventors: David Potts, 385 Roast Meat Hill Rd., Killingsworth, CT (US) 06419; Jerry Giroux, 100 Old Amherst Rd., Belchertown, MA (US) 01007

( * ) Notice: Subject to any disclaimer, the term of this patent is extended or adjusted under 35 U.S.C. 154(b) by 0 days.

(21) Appl. No.: 09/175,851

(22) Filed: Oct. 20, 1998

(Under 37 CFR 1.47)

Related U.S. Application Data

(60) Provisional application No. 60/063,607, filed on Oct. 20, 1997.

(51) Int. Cl.[7] ..... F04B 53/00; F04B 35/00; F04B 35/04

(52) U.S. Cl. ..... 417/234; 417/364; 417/424.1

(58) Field of Search ..... 417/234, 364, 417/423.1, 423.9, 423.6, 424.1

(56) References Cited

U.S. PATENT DOCUMENTS 1,840,257 A * 1/1932 Saxe et al. ..... 417/200
2,360,777 A * 10/1944 Bour ..... 103/87
2,798,973 A * 7/1957 Doyle ..... 310/6
3,135,466 A * 6/1964 Reid ..... 239/14
3,565,343 A * 2/1971 Alderfer ..... 239/261
3,915,596 A * 10/1975 Frazar ..... 417/423 R
3,958,895 A * 5/1976 Brisson ..... 415/121 B
4,844,701 A * 7/1989 Wolford et al. ..... 417/234
5,419,497 A * 5/1995 Warrington ..... 239/722

* cited by examiner

*Primary Examiner*—Charles G. Freay
*Assistant Examiner*—Timothy P. Solak
(74) *Attorney, Agent, or Firm*—Brown & Michaels, PC

(57) ABSTRACT

An apparatus mounted on a trailer is used to connect to an underground pipe array such as is installed under a golf course. The apparatus includes a vertical shaft blower unit with an impeller rotating in a horizontal plane. An engine mounted on the blower unit has a vertical engine shaft connected to the vertical shaft of the blower unit. An inlet duct of the blower unit is located below a discharge duct of the blower unit. The inlet duct and discharge duct are oriented in the same direction, and when the engine is a gasoline engine having an exhaust muffler, the exhaust muffler is oriented in the same direction as the inlet and discharge ducts. Since all the noise discharge points of the apparatus are pointed in the same direction, the trailer can be turned so that the noise generated during operation of the apparatus is directed away from players on the golf course. A water separator is preferably connected between the inlet duct and the impeller. In addition, a frame is connected to either the blower unit or the trailer for easy stowage of the flexible hose used to connect the blower unit to the underground pipe array.

5 Claims, 1 Drawing Sheet

VERTICAL SHAFT BLOWER ON TRAILER

REFERENCE TO PROVISIONAL APPLICATION

This application claims an invention which was disclosed in Provisional Application No. 60/063,607 filed Oct. 20, 1997 and entitled "APPARATUS FOR REMOVING GASES AND WATER FROM SOIL SUBSURFACE." The benefit under 35 USC §119(e) of the United States provisional application is hereby claimed, and the aforementioned application is incorporated herein by reference.

FIELD OF THE INVENTION

The invention pertains to the field of blowers mounted on self-propelled vehicles. More particularly, the invention pertains to a blower unit mounted on a self-propelled vehicle or trailer pulled by a vehicle suitable for use on a golf course.

BACKGROUND OF THE INVENTION

In U.S. Pat. No. 5,617,670 (Benson), a mobile unit suitable for use on a golf course for treating soil is disclosed. A blower is mounted on the mobile unit, as shown in FIGS. 1 and 2 of Benson, with the blower shaft horizontal and the blower housing and impeller lying along the vertical plane. Such blowers are typically driven by either a gasoline motor or an electric motor. Gasoline motors make exhaust noise while electric motors need to be run using an extension cord from a commercial power source or from a battery or bank of batteries that need frequent recharging. The blower discharge pipe and blower inlet pipe face in different directions, and neither direction is necessarily the same direction as the exhaust duct of the gasoline motor. A problem arises when operating the blower while the golf course is used by golfers, since the noise disturbs the enjoyment of the golfers.

SUMMARY OF THE INVENTION

An apparatus mounted on a trailer is used to connect to an underground pipe array such as is installed under a golf course. The apparatus includes a vertical shaft blower unit with an impeller rotating in a horizontal plane. An engine mounted on the blower unit has a vertical engine shaft connected to the vertical shaft of the blower unit. An inlet duct of the blower unit is located below a discharge duct of the blower unit. The inlet duct and discharge duct are oriented in the same direction, and when the engine is a gasoline engine having an exhaust muffler, the exhaust muffler is oriented in the same direction as the inlet and discharge ducts. Since all the noise discharge points of the apparatus are pointed in the same direction, the trailer can be turned so that the noise generated during operation of the apparatus is directed away from players on the golf course. A water separator is preferably connected between the inlet duct and the impeller. In addition, a frame is connected to either the blower unit or the trailer for easy stowage of the flexible hose used to connect the blower unit to the underground pipe array.

According to an embodiment of the invention, an apparatus mounted on a trailer includes a blower unit having a vertical shaft, an impeller of the blower unit rotating in a horizontal plane, an engine mounted on the blower unit having a vertical engine shaft connected to the vertical shaft of the blower unit, and an inlet duct of the blower unit being below a discharge duct of the blower unit.

According to an embodiment of the invention, an apparatus mounted on a trailer includes a blower unit having a vertical shaft, an impeller of the blower unit rotating in a horizontal plane, an engine mounted on the blower unit having a vertical engine shaft connected to the vertical shaft of the blower unit, an inlet duct of the blower unit being below a discharge duct of the blower unit, wherein the inlet duct and the discharge duct are oriented in a same direction, and wherein the engine has an exhaust muffler and the exhaust muffler is oriented in the same direction as the inlet duct and the discharge duct.

DESCRIPTION OF THE PREFERRED EMBODIMENT

Figure 1:
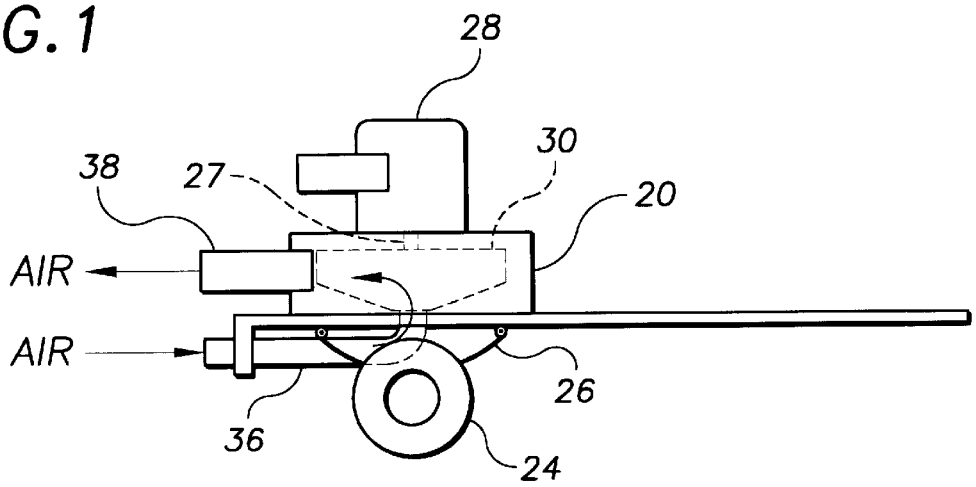
FIG. 1 shows a side elevation view of a vertical shaft blower mounted on a trailer according to the present invention.
Figure 2:
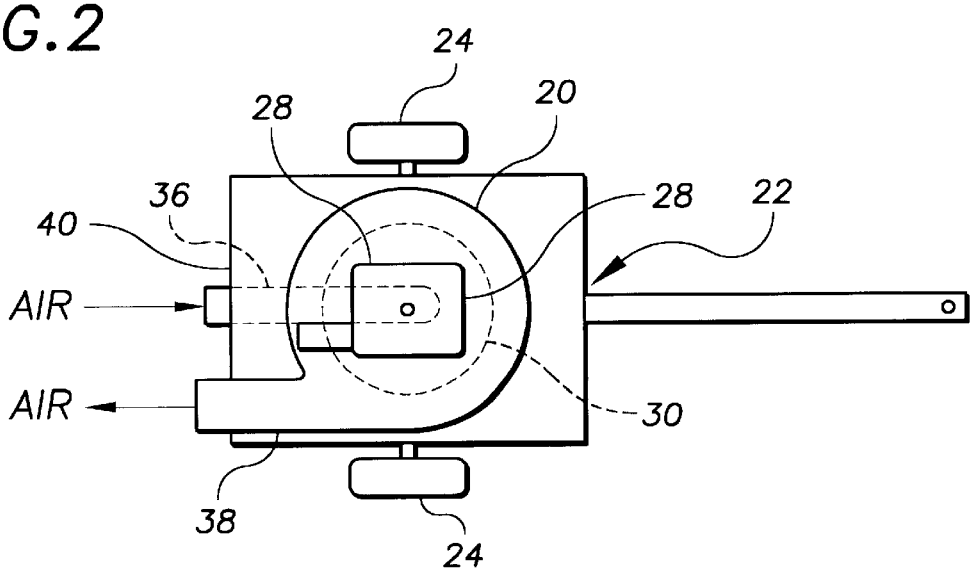
FIG. 2 shows a top plan view of the invention of FIG. 1.

Referring to FIGS. 1–2, a blower unit 20 is mounted so it is in the horizontal plane and lies on a bed of a trailer 22. Blower unit 20 is preferably of the centrifugal type. Trailer 22 includes a conventional pair of wheels 24 and springs 26. An engine 28, preferably gasoline but possibly electric, is mounted vertically above and upon blower unit 20. A blower impeller 30, which typically is a closed and radially tapering impeller, is hung from an engine shaft 27 of engine 28. In this design, the distance from impeller 30 to a support bearing (not shown) of the engine is minimized, compared to the prior art horizontal mounting. The support structure for engine 28 is simplified compared to the prior art.

An exhaust muffler 34 of engine 28 is oriented toward a rear end 40 of trailer 22, as is a discharge duct 38 of blower unit 20. An inlet duct 36 for blower unit 20 also runs from the rear, curving upwardly to an underside of trailer 22 to connect to a central inlet point of blower unit 20. Thus, all sounds which emanate during operation of engine 28 from muffler 34 and ducts 36, 38 emanate in the same direction, so that trailer 22 can be oriented desirably to send sound away from wherever players are on the golf course, thus minimizing their disturbance by noise. Blower unit 20 can be powered by an electric motor, in which case obviously there is no muffler. All the noise discharge points can be alternately aimed sideways or in another direction relative to trailer 22, as long as all noise discharge points are oriented in the same direction.

The design of the present invention is particularly compact compared to the prior art trailer-blowers. There is a general lowering of the center of gravity of both the housing and motor, thereby leading to stability on sloped surfaces. The inlet point of the blower is desirably lowered nearer to the earth surface. This means there is less difference in elevation between the inlet and the near-ground level connection point of a typical buried subterranean pipe array, which is significant when water is drawn into inlet duct 36, as sometimes occurs. Thus, compared to the prior art design, where the housing is typically of the order of 36 inches diameter, the housing of the present invention is about 18 inches in diameter, thereby saving about 18 inches of head with the vertical shaft design. This is significant in that a typical high suction blower provides 30–60 inch water column static pressure. During normal operation, either inlet duct 36 or discharge duct 38 is connected to a pipe array (not shown) that is installed under selected portions of the golf course as described in U.S. Pat. No. 5,617,670, incorporated herein by reference. Less suction head is absorbed for moving the water in the pipe, so that more suction remains available for the desired purpose of acting on the turf of the field.

Another feature is that that any residual water condensate and the like which remains in the housing after cessation of operations tends to fall down and out of inlet duct 36 onto the ground.

Figure 3:
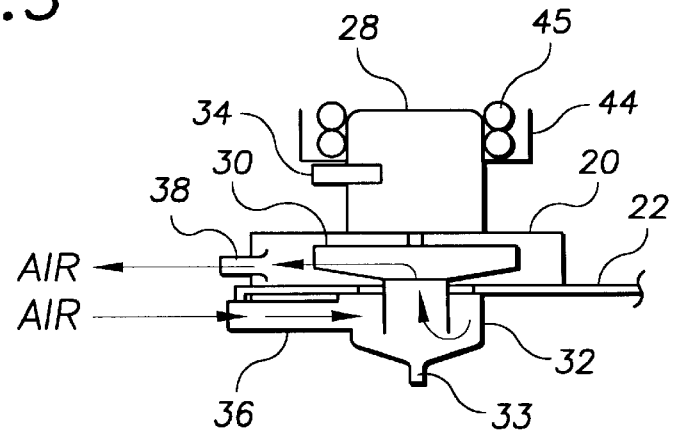
FIG. 3 shows a partial cross-sectional view of the vertical shaft blower of FIGS. 1 and 2.

Referring to FIG. 3, the design of the present invention enables easy installation of an impact or centrifugal water separator 32 at the inlet point of the housing. Water that enters inlet duct 36 along with air falls into water separator 32 and then preferably through a one-way drain valve 33 onto the ground. The blades of blower impeller 30 are thus prevented from being damaged by the water. Also shown in FIG. 3 is a frame 44 attached to engine 28, or alternately attached directly to trailer 22, for stowing a length of flexible tubing 45, suitable for connecting blower inlet duct 36 or discharge duct 38 to the pipe array (not shown) which is being dealt with, above engine 28.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. An apparatus mounted on a trailer comprising:

a) a blower unit having a vertical shaft connected to a frame, wherein at least one flexible hose can be stowed on the frame;

b) an impeller of said blower unit rotating in a horizontal plane;

c) an inlet duct of said blower unit being below a discharge duct of the blower unit, wherein the inlet duct and the discharge duct are oriented in the same direction; and d) an engine mounted on said blower unit having a vertical engine shaft connected to said vertical shaft of the blower unit, wherein said engine has an exhaust muffler and said exhaust muffler is oriented in the same direction as said inlet duct and said discharge duct.

2. An apparatus mounted on a trailer comprising:

a) a blower unit having a vertical shaft connected to a frame, wherein at least one flexible hose can be stowed on the frame;

b) an impeller of said blower unit rotating in a horizontal plane;

c) an inlet duct of said blower unit being below a discharge duct of the blower unit, wherein the inlet duct and the discharge duct are oriented in the same direction;

d) an engine mounted on said blower unit having a vertical engine shaft connected to said vertical shaft of the blower unit; and e) a water separator connected between said inlet duct and said impeller.

3. An apparatus mounted on a trailer, comprising:

a) a blower unit having a vertical shaft;

b) an impeller of said blower unit rotating in a horizontal plane;

c) an engine mounted on said blower unit having a vertical engine shaft connected to said vertical shaft of said blower unit;

d) an inlet duct of said blower unit being below a discharge duct of said blower unit;

e) wherein said inlet duct and said discharge duct are oriented in a same direction; and f) wherein said engine has an exhaust muffler and said exhaust muffler is oriented in the same direction as said inlet duct and said discharge duct.

4. An apparatus according to claim 3, further comprising a water separator connected between said inlet duct and said impeller.

5. An apparatus according to claim 3, further comprising a frame connected to one of said blower unit and said trailer, whereby at least one flexible hose can be stowed on said frame.

* * * * *